US005937375A

United States Patent [19]

Nakamura

[11] Patent Number: 5,937,375

[45] Date of Patent: Aug. 10, 1999

[54] VOICE-PRESENCE/ABSENCE DISCRIMINATOR HAVING HIGHLY RELIABLE LEAD PORTION DETECTION

[75] Inventor: Kazuo Nakamura, Oobu, Japan

[73] Assignee: Denso Corporation, Kariya, Japan

[21] Appl. No.: 08/758,250

[22] Filed: Nov. 27, 1996

[30] Foreign Application Priority Data

Nov. 30, 1995 [JP] Japan ..... 7-312814

[51] Int. Cl.[6] ..... G10L 9/18

[52] U.S. Cl. ..... 704/215; 704/214

[58] Field of Search ..... 704/210, 215, 704/214, 233, 208; 381/94.2, 94.3, 110

[56] References Cited

U.S. PATENT DOCUMENTS

| | | | |
|---|---|---|---|
| 4,351,983 | 9/1982 | Crouse et al. . | |
| 5,016,205 | 5/1991 | Shumway . | |
| 5,649,055 | 7/1997 | Gupta et al. | 704/215 |
| 5,664,052 | 9/1997 | Nishiguchi et al. | 704/214 |

FOREIGN PATENT DOCUMENTS

| | | |
|---|---|---|
| 5-323996 | 12/1993 | Japan . |
| 6-75599 | 3/1994 | Japan . |

*Primary Examiner*—Vivian Chang
*Attorney, Agent, or Firm*—Pillsbury Madison & Sutro LLP

[57] ABSTRACT

A voice presence/absence discriminator can accurately determine the presence or absence of a voice in a frame that includes an uttered syllable head portion of an input voice and avoids performing erroneous determinations in bad environments such as those where background noise is of a high magnitude. In a sub-frame power calculation section, a sub-frame power Pm is calculated in units of sub-frames prepared by dividing a frame into four sub-frame portions. Based on this sub-frame power Pm, in a frame maximum power production section, a moving average (short-period average value) of the power of a sub-frame and the power of a sub-frame that precedes this sub-frame by one unit are calculated in units of a sub-frame and the short-period average values are compared with each other among the sub-frames that constitute the same frame to thereby select a maximum one of them as the frame maximum power Pf of this frame. As a result, even when voicing has been started from an ending half of the frame, there is no possibility that the frame maximum power Pf will be determined to be small in magnitude and this frame is reliably determined to be a voice presence frame in a voice presence determination portion.

19 Claims, 8 Drawing Sheets

$Pb(i)=\min\{PAL(i,0),PAL(i,1),PAL(i,2),PAL(i,3)\}$ $Pf(i)=\max\{PAS(i,0),PAS(i,1),PAS(i,2),PAS(i,3)\}$ i-2
i-1
i
i+1
FRAME INPUT VOICE SIGNAL Xs
10000
0
-10000

SUB-FRAME PWR. SHORT PD. AVG. PAS
3000
0
PAS(i,3)

MAX. FRAME PWR. Pf
3000
0
Pf(i)=PAS(i,3)

VOICE-PRESENCE/ABSENCE DISCRIMINATOR HAVING HIGHLY RELIABLE LEAD PORTION DETECTION

CROSS-REFERENCE TO RELATED APPLICATION

The present application is related to and claims priority from Japanese Patent Application No. Hei 7-312814, incorporated herein by reference.

BACKGROUND OF THE INVENTION

1. Field of the Invention

The present invention relates to a voice presence/absence discriminator which discriminates between the presence and absence of an input voice signal in a voice analysis/synthesis system. More particularly, the invention concerns a voice presence/absence discriminator which, in a digital mobile radio communication system which transmits and receives coded data obtained by analyzing the voice signal in units of a frame per prescribed time period, is applied to a VOX (Voice-Operated Transmitter) as a low power consumption control for increasing the continuous use time length in a mobile station.

2. Description of Related Art

Conventionally, it has been usual that in a mobile station used in a mobile radio communication network the continuous conversation time is limited due to the limited capacity of the battery as a power source and therefore, an effort is made to extend the continuous conversation time by contracting various kinds of low power consumption controls.

As one of the various relevant techniques for such low power consumption control, there is known a VOX (Voice Operated Transmitter) control which, utilizing the fact that the continuous occurrences of speaking voices in a telephone conversation is small, stops the operation of the transmission circuit when no voice is generated, for example, when listening to the other party's speech, to thereby control the power consumption and increase the telephone conversation time.

In order to realize such VOX control, it is necessary to accurately discriminate between the presence and absence of a voice signal to be transmitted. As a device meeting such a requirement, Japanese Unexamined Patent Publication No. Hei 5-323996 discloses a voice presence/absence discriminator which is used in a transmitter equipped with a voice encoder that performs high-efficiency encoding of a voice signal in units of a frame per prescribed time length, and which discriminates between the presence and absence of the voice in units of a frame.

In this voice presence/absence discriminator, during the voice presence period in which the voice signals are being transmitted, discrimination between the presence and absence of the voice signal in the frame is performed by the use of the frame average power obtained every frame and parameters obtained in the voice encoder in the process of high-efficiency encoding of the voice signal which indicate the characteristics of the voice and, on the other hand, during the voice absence period in which the transmission of the voices is stopped, discrimination is performed between the presence and absence of the voice signals in the frame only on the basis of the frame average power because the voice encoder is also stopped for the purpose of reducing the power consumption.

However, in this device, since the presence and absence of the voices during the voice absence period is discriminated using only the average power of the frame, there is a problem that when a voice signal is beginning to be generated, the leading portion of the voice tends to be disconnected with the result that the naturalness of the voice is impaired.

That is, since the size of the frame used in this type of device is usually as long as 20 ms or so, when an utterance starts from the latter half of the frame, the average power of the frame that includes the leading portion of the voice becomes small and therefore it is likely that this frame is erroneously determined to be a voice absence frame. As a result of this, the disconnection of the leading portion of the voice takes place.

Also, when in order to prevent the occurrence of such disconnection the threshold value for discrimination between the presence and absence of the voices in the frame is set to a small value, the discrimination is likely to receive influences such as that of the fluctuation of the background noise, with the result that the erroneous operation of determining a voice absence frame to be a voice presence frame occurs frequently. As a result of this, there is the problem that it is impossible to execute the VOX control effectively.

SUMMARY OF THE INVENTION

The present invention has been made in order to solve the above-mentioned problems of the prior art and has an object to provide a voice presence/absence discriminator which can accurately discriminate between the presence and absence of a voice signal in a frame that includes the leading portion of the voice and, in addition, rarely performs erroneous discriminations even in bad environments such as those where the background noise level is high.

The above objects are achieved according to a first aspect of the present invention by providing a system in which, when the voice signal is input in an amount corresponding to the sub-frame that is prepared by dividing the base frame into a prescribed number of sub-frames, a sub-frame power calculation unit calculates the sub-frame power which is the power value of a respective sub-frame. When the voice signal is input thereafter in an amount corresponding to the base frame, the frame maximum power production unit selects, among the sub-frame powers of the sub-frames constituting this base frame, a maximum one thereof as the frame maximum power of the base frame. On the other hand, the background noise power estimation unit estimates the background noise power based on a plurality of consecutive sub-frames powers that include the most recent sub-frame power calculated by the sub-frame power calculation unit and that are calculated at the time of and prior to the calculation thereof.

The voice presence/absence discrimination unit determines the presence or absence of a voice signal in the base frame every base frame based on the difference between the frame maximum power and the background noise power.

As mentioned above, in the present invention, the sub-frame power is calculated every sub-frame and the resulting sub-frame powers are compared with one another among the sub-frames constituting the same base frame, whereby a maximum value thereof is selected as the frame maximum power and used for determination of the presence or absence of the voice signal made on the base frame.

Accordingly, according to the voice presence/absence discriminator of this aspect of the present invention, even when an utterance has been started from the ending half of the base frame, there is no possibility that the power of the corresponding voice signal may be averaged over an entire range of the base frame and, as in the case where the voice signal is present over an entire range of the base frame, it is possible to obtain the frame maximum power that substantially corresponds to the level of the power of the voice signal. For this reason, it is possible to reliably determine this frame to be the voice presence frame. As a result, when the voice presence/absence discriminator has been applied to the transmitter for transmitting the voice by encoding it in units of the base frame, it is possible to reliably prevent the occurrence of the uttered syllable head detection failure and thereby enhance the voice communication quality.

Also, since it is not necessary to set the threshold value for determining the presence or absence of the voice signal based on the difference between the frame maximum power and the background noise power to be at a small value for the purpose of preventing the uttered syllable head detection failure, it is possible to reliably decrease the number of the erroneous determinations in which the absence of the voice is determined to be the presence of the voice to thereby realize effective VOX control.

Also, while when as in the case of the conventional device, the processing is executed in units of the base frame the determination precision of the voice presence and voice absence becomes decreased as the size of the base frame increases with the result that the uttered syllable head detection failure or erroneous operation becomes likely to occur, since according to the present invention the determination precision is determined depending on the size of the sub-frame, it is possible to set the determination precision arbitrarily independently of the size of the base frame.

Preferably, the frame maximum power production unit is equipped with a short-period average value calculation unit which, each time the sub-frame power is calculated in the sub-frame power calculation unit, based on a prescribed number of consecutive sub-frames electric powers, wherein the sub-frames are smaller in number than the divisional number thereof, that include the most recent sub-frame electric power calculated by the sub-frame power calculation unit and that are calculated at the time of and prior to the calculation thereof, the short-period average value which is the average value thereof.

The frame maximum power production unit selects the frame maximum power based on this short-period average value instead of the sub-frame power. That is, in the present invention, instead of the sub-frame power which when large-amplitude noise is abruptly superimposed on the voice signal is influence directly by this superimposition, it is arranged to determine the frame maximum power by the use of the short-period average value which is the moving average of the sub-frame powers and thereby mitigate the influence of such noises.

Accordingly, according to the voice presence/absence discriminator of the present invention, it is possible to reliably decrease the erroneous determinations resulting from abrupt noises and the like.

Preferably, the background noise power estimation unit is composed of a long-period average value calculation unit and a selection unit. When the sub-frame power is calculated in the sub-frame power calculation unit, the long-period average value calculation unit sequentially calculates, based on a prescribed number of consecutive sub-frames, electric powers, wherein the sub-frames are larger in number than the divisional number thereof, that include the most recent sub-frame electric power calculated and that are calculated at the time of and prior to the calculation thereof, the long-period average value which is the average value thereof. Thereafter, when the voice signal is input in an amount that corresponds to the base frame, the selection unit selects, among the long-period average values of the sub-frame powers of the sub-frames constituting the same base frame which have been calculated by the long-period average value calculation unit, a minimum one thereof as the background noise power of this base frame. That is, in the present invention, the background noise power is determined based on the moving average of the sub-frame powers that are included in a plurality of consecutive base frames.

Therefore, according to the voice presence/absence discriminator according to this aspect of the present invention, since the background noise power that becomes a reference level for determining the voice presence or voice absence of the base frame exhibits no abrupt change in a manner to follow the abrupt fluctuation of the sub-frame power, it is possible to make a stable determination of the voice presence or voice absence on the base frame.

Preferably, the parameter extraction unit performs linear estimation analysis on the input voice signal every base frame to thereby extract a characteristic parameter that represents the characteristic of the frequency spectrum envelope of the input voice signal. In the voice presence/absence discrimination unit, the first determination unit determines that the base frame wherein the difference between the frame maximum power and the background noise power is not smaller than a prescribed first threshold value is a voice presence frame and that the base frame wherein the difference therebetween is not larger than a prescribed second threshold value that is smaller than the first threshold value is a voice absence frame. Also, when the power difference is larger than the first threshold value and smaller than the second threshold value, the second determination unit determines the voice presence or voice absence of the base frame based on the characteristic parameter that is extracted by the parameter extraction unit.

Meanwhile, generally, the characteristic parameter that is extracted by the performance of the linear estimated analysis represents a characteristic of the frequency spectrum envelope of the voice signal and exhibits different characteristic tendencies between when a voice is present and when a voice is absent. Therefore, it is known that with the use of this characteristic parameter, it is possible to discriminate between the presence of a voice and the absence of it to some extent with no dependency on the size of the background noise power.

And in the present invention, when determination is made of the voice presence or voice absence based on the difference between the frame maximum power and the background noise power, it is arranged to set the first threshold value to be at a level above which it is possible to determine the voice signal to have a voice almost reliably and to set the second threshold value to be at a level below which it is possible to determine the voice signal to have no voice almost reliably and, in a region between these two threshold values where there is a high possibility of the erroneous determination occurring when determination is made using the difference between the frame maximum power and the background noise power, to determine the voice signal according to the characteristic parameter.

Therefore, according to the voice presence/absence discriminator according to the present invention, even when the background noise power is high in magnitude with the result that the difference between the frame maximum power and the background noise power is small, it is possible to determine the voice presence or voice absence more reliably and therefore to enhance the determination precision of the voice presence or voice absence compared to the case where determination thereof is made based merely on the difference between the frame maximum power and the background noise power.

That is, although the characteristic parameter is not a value that enables reliable determination of the voice presence or voice absence on the base frame, since the use thereof enables this determination with no dependency on the background noise power, it is possible to supplementarily use the determination based on the application of the characteristic parameter in a range where it is delicate to determine with the use of the frame maximum power and thereby enhance the determination precision of the voice presence or voice absence effectively.

Preferably, the characteristic parameter that is extracted by the parameter extraction unit and used in the determination performed in the second determination unit is characterized to be a low-order reflection coefficient. Here, the n-th order reflection coefficient rn corresponds, as shown in Equation (1), to a value that has been obtained by normalizing the n-th degree autocorrelation coefficient Rn of the input signal by the total energy (0-th degree autocorrelation coefficient) R0.

$$rn=-Rn/R0 \tag{1}$$

It is to be noted that the n-th degree autocorrelation coefficient Rn is, as shown in Equation (2), a value which is obtained by multiplying discretely expressed voice waveform data xi by the data xi-n that precedes by n samples and summing up the resulting data values throughout all multiplications.

$$Rn = \sum_i \{xi \cdot xi - 1\} \tag{2}$$

It is well known that is the distribution of the low-order reflection coefficient, a voiced sound (vowel, etc.) and a voiceless sound (voiceless consonant, background noise, etc.) are separated from each other comparatively well.

For example, considering the case of the first-order reflection coefficient r1, the voiced sound has a clear formant structure in a low frequency range and therefore the first degree autocorrelation coefficient R1 thereof exhibits a value that is similar to the total energy R0 while, on the other hand, the voiceless sound in many cases exhibits no partiality in the frequency spectrum and therefore the first degree autocorrelation R1 thereof exhibits a small value. As a result, the first-order reflection coefficient r1 becomes approximately 1 in the case of a voiced sound and, in the case of a voiceless sound, becomes approximately 0.

Further, while the voiceless sound includes voiceless consonants and the background noise, the difference between the schematic configurations of the frequency spectra thereof is reflected in the first-order reflection coefficient r1. That is, in the case of the voiceless sound whose frequency spectrum has relatively large components in a high frequency range of 3 to 10 kHz and which therefore exhibits a high range stress frequency characteristic, the first-order reflection coefficient r1 becomes biased toward the +1 side while, on the other hand, in the case of the background noise whose frequency characteristic has an inclination of −9 dB/oct or so and therefore exhibits a low range stress frequency characteristic, the first-order reflection coefficient r1 becomes biased toward the −1 side.

As mentioned above, when the input sound signal indicates the existence of a sound, i.e., contains the voiced sound and voiceless sound, the first-order reflection coefficient r1 becomes a value which is approximately +1, whereas when the input sound signal does not indicate the existence of a sound, i.e., contains the background noise alone, the first-order reflection coefficient r1 becomes a value which is approximately −1. Thus, the first-order reflection coefficient r1 exhibits a well-separated characteristic feature.

It is to be noted that while the voiced sound such as a vowel also exhibits a low range stress frequency characteristic as in the case of the environmental noise, since it usually has a sufficiently large power as compared to the background noise, it can be usually separated sufficiently from the latter by the voice presence/absence determination that is made based on the difference between the frame maximum power and the background noise power.

Accordingly, by using the voice presence/absence determination that is made using the low-order reflection coefficient rn that has the above-mentioned characteristics concurrently with the voice presence/absence determination on the basis of the difference between the frame maximum power and the background noise power, it is possible to further enhance the accuracy of determination precision of the voice presence or voice absence on the base frame.

Preferably, the period determination unit determines, among the voice presence frames that have been so determined and the voice absence frames that have been so determined by the voice presence/absence discrimination, the voice presence frame and voice absence frames included in a prescribed number of such frames that consecutively succeed this voice presence frame to be the voice presence period and determines, among those voice presence and absence frames, the voice absence frame that further consecutively succeeds the prescribed number of the voice absence frames that consecutively succeed the voice presence frame to be the voice absence period.

That is, it is arranged, even when the voice absence frame appears immediately after the voice presence frame, not to determine it to be the voice absence period immediately and it is arranged, when the voice absence frames have succeeded the voice presence frame consecutively in a prescribed number or a number that is larger than this prescribed number, to determine the thereafter succeeding voice absence frame to be the voice absence period. Whereby, it is arranged to prevent the voice presence period and voice absence period from being frequently changed over by, for example, every short absence of voice during an utterance such as breathing during a conversation being determined to be the voice absence period.

Therefore, according to the voice presence/absence discriminator of the present invention, when the VOX control is performed based on the voice presence/absence period that is so determined here in this discrimination, it is possible to prevent the occurrence of the feeling of unnaturalness that results from, for example, the uttered syllable head reproduction failure due to the frequent performances of the VOX control. Also, since it does not happen that the voice absence frame immediately succeeding the voice presence frame fails to be reproduced, it is possible to reliably prevent the occurrence in the voice of an uttered syllable end reproduction failure.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

An embodiment of the present invention will now be explained with reference to the accompanying drawings.

Figure 2:
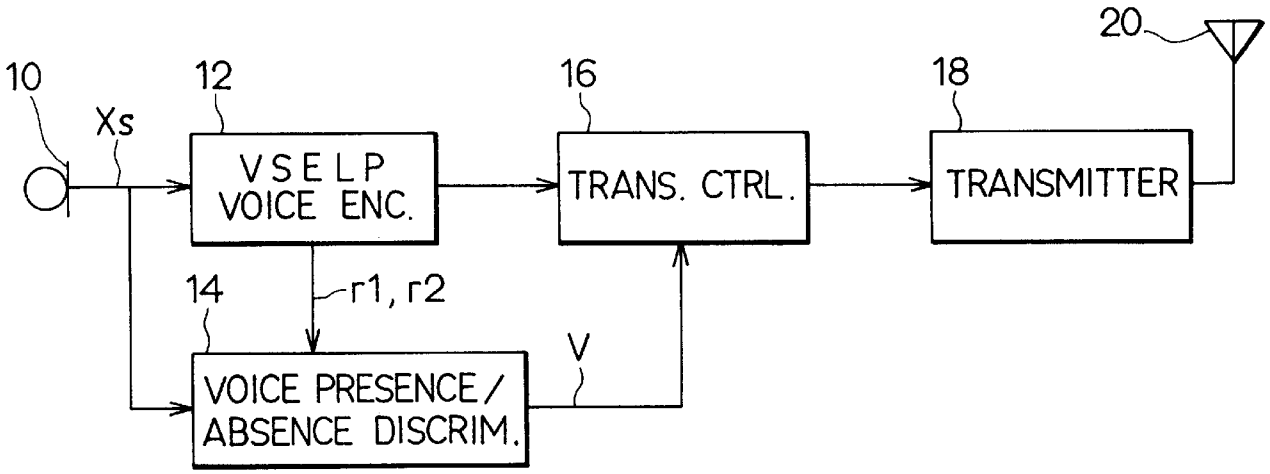
FIG. 2 is a block diagram showing the construction of the transmission part of a mobile station used in an automotive vehicle telephone system to which the voice presence/absence discriminator of this embodiment has been applied.

FIG. 2 is a block diagram showing the construction of the transmission part of a mobile station used in a digital automotive vehicle telephone system to which a voice presence/absence discriminator according to the present invention is applied.

As shown in FIG. 2, the transmission part of the mobile station includes an input section 10 for performing sampling of a voice signal input through a microphone and converted to an electric signal in units of a 125 $\mu$s period (8 kHz) and converting the resulting signal to 16-bit digital data Xs, a voice encoder 12 for performing analysis processing on the digital data Xs from the input section 10 in units of a frame that has been prepared by dividing the digital data Xs into 20 ms (160 data) portions, a voice presence/absence discriminator 14 for determining, based on the digital data Xs input from the input section 10, whether the frame that has been processed in the voice encoder 12 is a voice presence frame that contains a voice signal or a voice absence frame that contains no voice signal and outputting, based on the determination made therein, a determination result V that represents which one of the voice presence period and voice absence period this frame belongs to, a transmission control section 16 for controlling, based on the determination result V from the voice presence/absence discriminator 14, the transmission of the coded data which has been produced in the voice encoder 12, and a transmitter 18 for producing a prescribed format of transmission frames according to the control data from the transmission control section 16 and transmitting the same through an antenna 20.

It is to be noted that the voice encoder 12 includes a digital signal processor (DSP) and performs encoding of the voice data using a known VSELP (Vector Sum Excited Linear Prediction) technique which is a voice encoding system that is determined as a standard for the digital automotive vehicle telephone system.

The voice encoder 12 of the VSELP system outputs, as coded data, various sound source information obtained as a result of simulating voices generated from one's vocal chords, filter factors for constructing a voice path equivalent filter simulating the vocal path and the like on the basis of the vocal chords (sound source) and the voice generating model which comprises the vocal chords (sound source) and vocal path and which is the fundamental model for high-efficiency voice encoding technology.

Among these data, the filter factor is determined by performing linear estimated analysis on the voice signal in units of a prescribed frame. It is to be noted that in the process of the calculation of this filter factor first to tenth reflection coefficients are determined, and among these reflection coefficients the first and second reflection coefficients r1 and r2 are input to the voice presence/absence discriminator 14.

Also, the sound source data is obtained by performing vector quantization on a sound source drive signal prepared by simulating the voice generated from the vocal chords, the resulting signal being called "a code vector", and determining, from among the code vectors plurally prepared therefrom, one whose synthesized sound is minimum in the distortion thereof, whereby the resulting code vector is output. However, this resulting code vector is not directly transmitted and the index of the basic vector that designates it indirectly is used for transmission. Also, as the sound source data, there are also outputted frame power values, etc.

Next, when the determination result V obtained from the voice presence/absence discriminator 14 changes from the voice absence period (V=0) to the voice presence period (V=1), the transmission control section 16 starts the transmitter 18 and produces a preamble that corresponds to two frames (40 ms) as a signal for information of the transmission start and causes it to be input to the transmitter 18. Subsequently, so long as the determination result V is the voice presence period (V=1), it consecutively transmits the coded data from the voice encoder 12 to the transmitter 18. When the determination result V changes from the voice presence period (V=1) to the voice absence period (V=0) thereafter, it transmits non-transmitted coded data (that corresponds to two frames here) to the transmitter 18. Further, it produces a postamble that corresponds to three frames (60 ms) as a signal for information of the transmission stop, causes it to be input to the transmitter 18 and then stops the transmitter 18.

Also, when the determination result V indicates that the voice absence period (V=0) persists for a long period of time, the transmission control section 16 starts the transmitter 18 every 50 frames (1000 ms) and produces the postamble and causes it to be input to the transmitter 18, causing it to be transmitted thereby, after which it stops the transmitter 18 again.

Figure 3A:
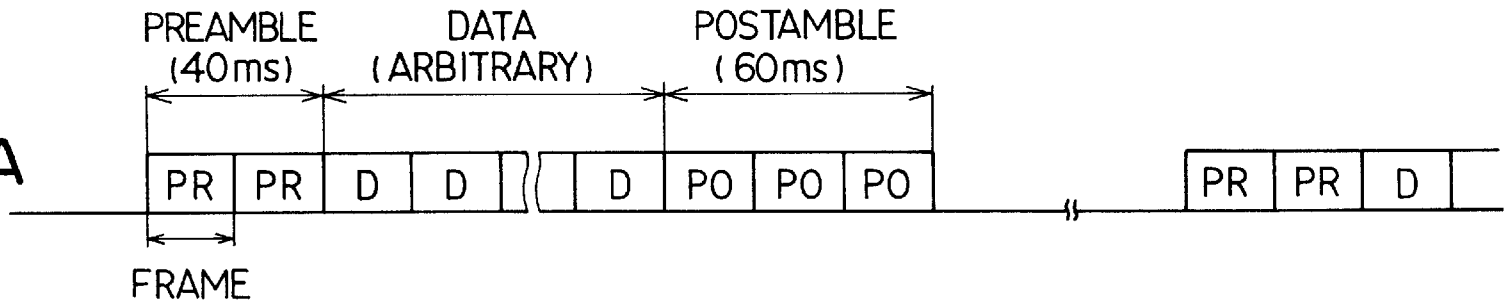
FIGS. 3A and 3B show a transmission frame that is produced in the transmission control section.
Figure 3B:
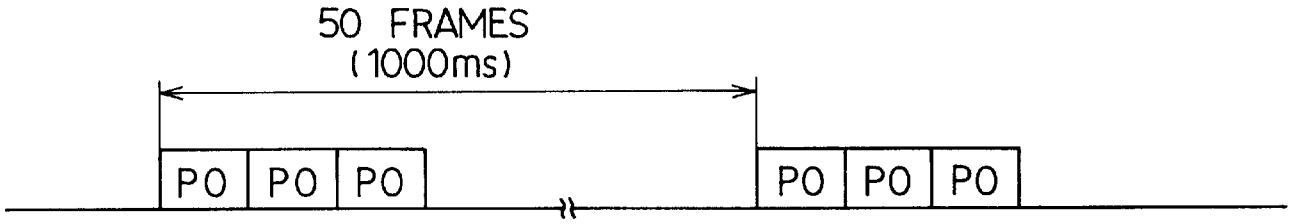

It is to be noted that the transmitter 18 transmits the preamble, coded data and postamble from the transmission control section 16 after having performed thereon processing such as conversion processing for converting them to prescribed transmission codes. FIGS. 3A and 3B show the construction of the transmission frame that is to be transmitted from the transmitter 18.

Figure 1:
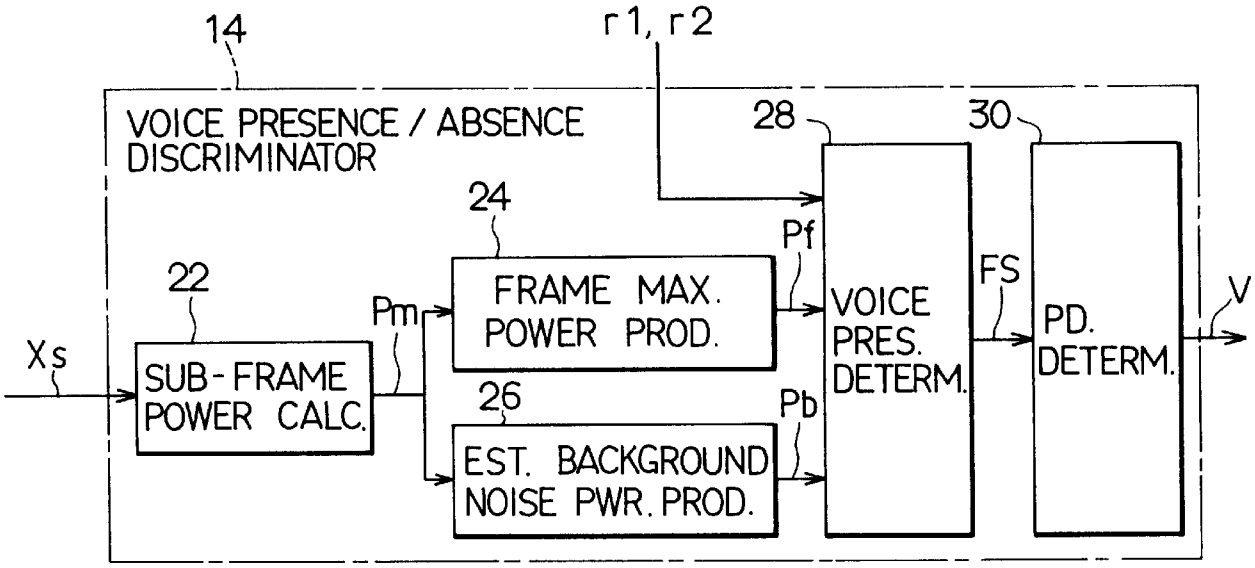
FIG. 1 is a block diagram showing the construction of a voice presence/absence discriminator according to an embodiment of the present invention.

Next, as shown in FIG. 1, the voice presence/absence discriminator 14 includes a sub-frame power calculation section 22 for sequentially inputting the digital data Xs from the input section 10 and calculates, in units of a sub-frame that is prepared by further dividing the frame in units of which data is encoded in the voice encoder 12 into four units and thereby dividing the frame every 50 ms data, the power Pm within this sub-frame, a frame maximum power production section 24 for producing a frame maximum power Pf based on the sub-frame power Pm that is sequentially calculated in the sub-frame power calculation section 22, an estimated background noise power production section 26 for producing an estimated background noise power Pb based similarly on the sub-frame power Pm, a voice presence determination section 28 for determining the voice presence or absence of the frame based on the frame maximum power Pf, estimated background noise power Pb and the first and second reflection coefficients from the voice encoder 12, and a period determination period 30 for determining, based on a frame state FS which is the determination result of the voice presence determination section 28, the voice presence period in which the coded data is to be transmitted and the voice absence period in which the transmission thereof is to be stopped.

Incidentally, the voice presence/absence discriminator 14 includes a well-known microprocessor that is composed mainly of a CPU, ROM and RAM. In this embodiment, the voice encoder 12 (DSP) and the voice presence/absence discriminator 14 are constituted by the same single-chip microprocessor. Also, the above-mentioned sub-frame power calculation section 22, frame maximum power production section 24, estimated background noise power production section 26, voice presence discriminator 28 and period determination section 30 are realized as the processes that are executed by the operations of the CPU.

The processes that are executed in the respective sections of the voice presence/absence discriminator 14 will hereafter be explained along with the flowcharts involved therewith.

Figure 4:
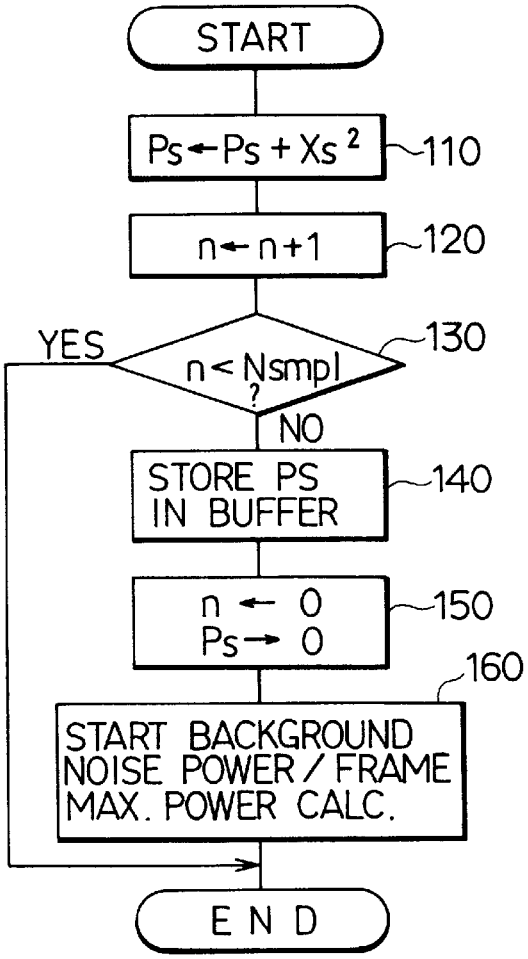
FIG. 4 is a flowchart showing a sub-frame power calculation process.

FIG. 4 is a flowchart showing the sub-frame power calculation process that corresponds to the sub-frame power calculation section 22. This process is started each time the input voice signal is sampled in the input section 10, i.e., in units of a 125 $\mu$s period.

It is assumed that the respective variables Ps and n that are used in this process are cleared to zero in the initialization processing that is executed immediately after the input of the power to the voice presence/absence discriminator 14.

First, in step 110, by adding to the variable Ps the digital data $Xs^2$ supplied from the input section 10, determination is made of the accumulated value of the digital data $XS^2$, i.e., the integrated value of the signal power, and, in subsequent step 120, the counted value n that represents the addition frequency of the digital data $Xs^2$ is incremented, the operation then proceeding to step 130.

In step 130, it is determined whether the counted value n is smaller than the value N smpl (40 in this embodiment) that corresponds to one sub-frame. If the counted value n is smaller, this process is terminated as is. On the other hand, if the counted value n has reached the comparison value N smpl, it is determined that the calculation of the power of the one sub-frame has been terminated, the operation then proceeding to step 140 in which the accumulated value of the digital data $Xs^2$, i.e., sub-frame power Ps, is stored in a prescribed buffer.

It is to be noted that the buffer is constructed in the form of a ring buffer and arranged to permit the most recent sub-frame power Ps to be stored at all times in a buffer of a prescribed length N buff that is needed to calculate a long-period average value as described later.

In subsequent step 150, in order to make preparations for the processing of the next sub-frame, the accumulated value Ps and counted value n are cleared to zero and, in subsequent step 160, the background noise power/frame maximum power calculation process that corresponds to the frame maximum power production section 24 and estimated background noise power production section 26 is started, after which the present process is terminated.

Figure 5:
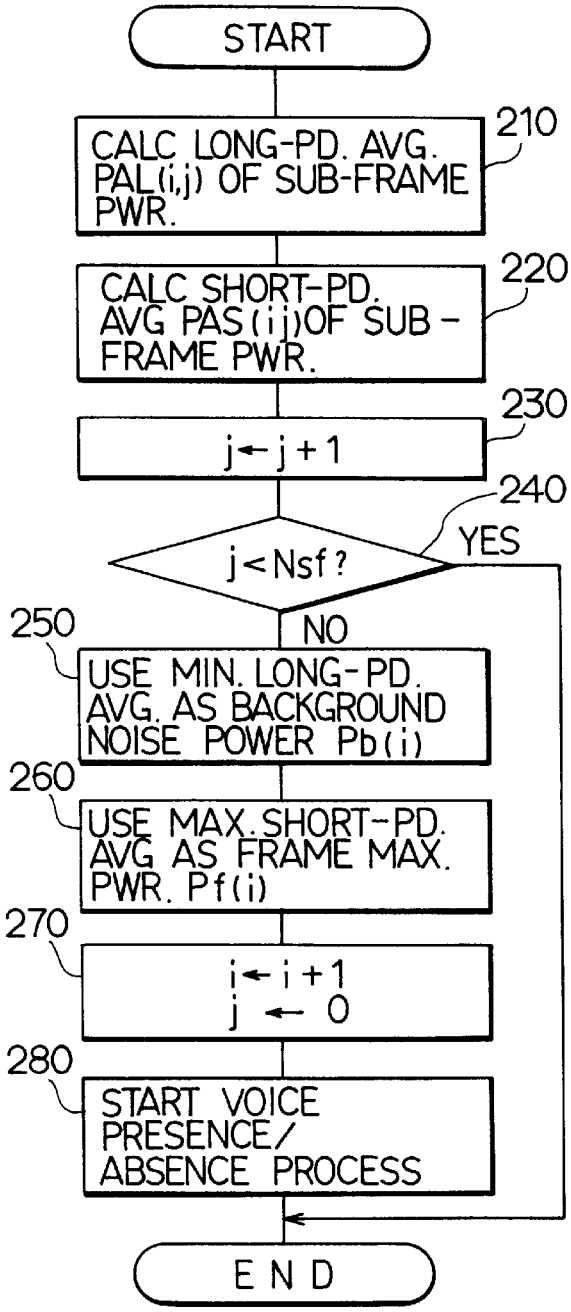
FIG. 5 is a flowchart showing a background noise power/frame maximum power calculation process.

Next, FIG. 5 is a flowchart showing the background noise power/frame maximum power calculation process. This process is periodically started each time the calculation of the sub-frame power of one sub-frame by the execution of the preceding sub-frame power calculation process, i.e., at sub-frame intervals (5 ms) is terminated.

It is to be noted that the variables i and j that are used in this process are those which are intended for the purpose of discriminating between the frame i and sub-frame j that are presently being processed and it is assumed that, as in the case of the variable used in the preceding sub-frame power calculation process, these variables be cleared to zero in the initialization processing.

As shown in FIG. 5, upon start of this process, first, in step 210, the long-period average value PAL(i, j) of the sub-frame power is calculated according to Equation (3) and, in subsequent step 220, the short-period average value PAS(i, j) of the sub-frame power is calculated according to Equation (4).

$$PAL(i, j) = \frac{\sum_{k=0}^{Nb-1} Pm(k)}{Nb} \tag{3}$$

$$PAS(i, j) = \frac{\sum_{k=0}^{Nf-1} Pm(k)}{Nf} \tag{4}$$

Here, Pm(k) represents the sub-frame power value which in the preceding step 140 is stored in the buffer and it is assumed that the most recent sub-frame power value that has been now calculated is represented by Pm(0) and the sub-frame power value that was calculated k times before is represented by Pm(k).

Figure 6:
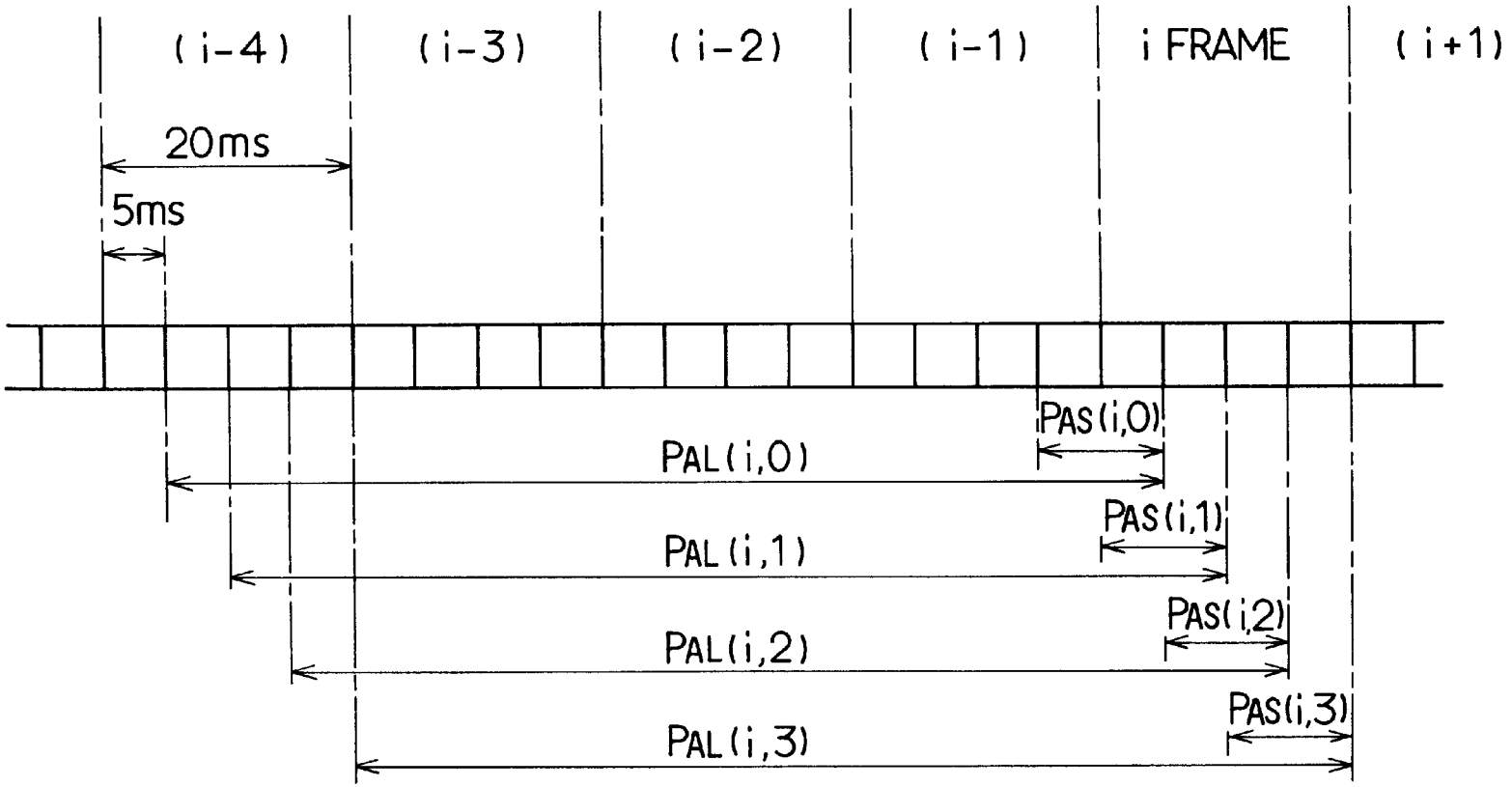
FIG. 6 shows the background noise power and the frame maximum power.

That is, as shown in FIG. 6, the long-period average value PAL(i, j) of the sub-frame power is the average value of a prescribed number of consecutive sub-frames power values Nb (16 units in this embodiment) that includes the most recent sub-frame power value calculated in the sub-frame power calculation process and that are calculated at the time of and prior to the calculation of this most recent sub-frame power value while, on the other hand, the short-period average value PAS(i, j) of the sub-frame power is the average value of a prescribed number of consecutive sub-frames power values Nf (2 units in this embodiment) that include the most recent sub-frame power value and that are calculated at the time of and prior to the calculation of this most recent sub-frame power value. It is to be noted therefore that both long- and short-period average values are the moving averages of the sub-frame power values.

In subsequent step 230, the variable j is incremented, with the operation then proceeding to step 240.

In step 240, it is determined whether the variable j is smaller than the sub-frames number Nsf (4 here at this step) within one frame. If the variable j is smaller, it is determined that the processing that corresponds to one frame has not yet been completed, the present process then being terminated.

On the other hand, if the variable j has reached the sub-frames number Nsf, it is determined that the processing that corresponds to one frame has been completed, the operation then proceeding to step 250 in which according to Equation (5) a minimum one of the long-period average values PAL(i, j) that have been calculated every sub-frame that constitutes this frame is calculated as the background noise power Pb(i) thereof. In subsequent step 260, according to Equation (6), a maximum one of the short-period average values PAS(i, j) is calculated as the frame maximum power Pf(i) of that frame.

$$Pb(i) = \min\{PAL(i, 0), PAL(i, 1), PAL(i, 2), PAL(i, 3)\} \quad (5)$$

$$Pf(i) = \max\{PAS(i, 0), PAS(i, 1), PAS(i, 2), PAS(i, 3)\} \quad (6)$$

In subsequent step 270, the variable i for discriminating between the frames is incremented and the variable for discriminating between the sub-frames is cleared to zero.

In subsequent step 280, the voice presence/absence determination process that corresponds to the voice presence determination section 28 is started, whereby the present process is terminated.

Figure 7:
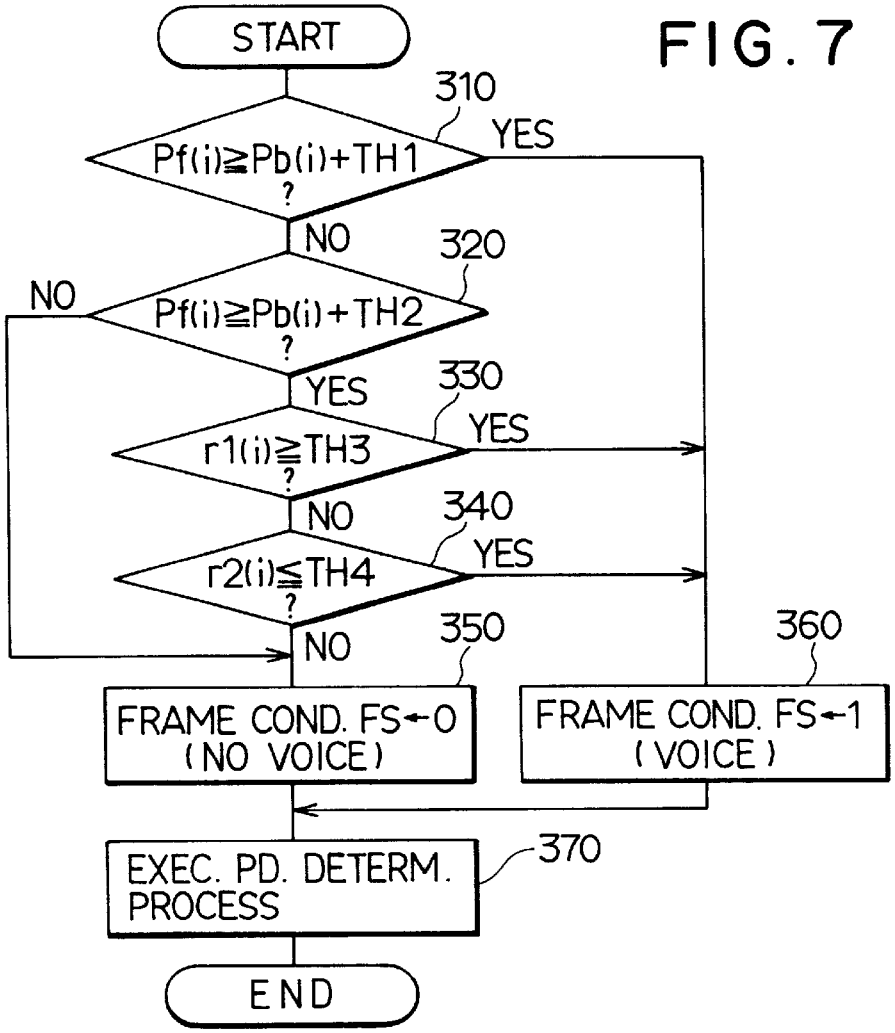
FIG. 7 is a flowchart showing a voice presence/absence discrimination process.

Next, FIG. 7 is a flowchart showing the operation of the voice presence/absence discriminator. This process is started periodically each time the background noise power and frame maximum power of one frame is calculated by the background noise power and frame maximum power calculation process, i.e., at frame intervals (20 ms).

As shown in FIG. 7, upon start of this process, first, step 310 determines whether the frame maximum power Pf(i) is not smaller than a comparison value that has been prepared by adding a first threshold value TH1 (50 in this embodiment) to the background noise power Pb(i). If the frame maximum power Pf(i) is not smaller than the comparison value, the operation proceeds to step 360 while, on the other hand, if the frame maximum power Pf(i) is smaller than it, the operation then proceeds to step 320.

Step 320 determines whether the frame maximum power Pf(i) is not smaller than a comparison value that has been prepared by adding a second threshold value TH2 (30 in this embodiment) to the background noise power Pb(i). If the frame maximum power Pf(i) is not smaller, the operation proceeds to step 330 while, on the other hand, if the frame maximum power Pb(i) is smaller, the operation proceeds to step 350.

Step 330 determines whether the first-order reflection coefficient r1(i) that has been calculated by performing linear estimated analysis of one frame in the voice encoder 12 is not smaller than a third threshold value TH3 (0.7 in this embodiment). If the former is not smaller than the latter, the operation proceeds to step 360 while, on the other hand, if this former is smaller than the latter, the operation proceeds to step 340.

Step 340 determines whether the second-order reflection coefficient r2 (i) is not larger than a fourth threshold value TH4. If the former is not larger than the latter (0.3 in this embodiment), the operation proceeds to step 360 and, if the former is larger than the latter, the operation proceeds to step 350.

In step 350, the variable FS that represents the determination result on the voice presence or absence of the frame is set to be at a value (FS=0) that represents the absence of the voice, the operation proceeding to step 370. On the other hand, in step 360, the variable FS is set to be at a value (FS=1) that represents the presence of the voice, the operation then proceeding to step 370.

In step 370, the period determination process that corresponds to the period determination section 30 is executed, the present process then being terminated. That is, when the frame maximum power Pf(i) is not smaller than the value that has been obtained by adding the first threshold value TH1 to the background noise power Pb(i), it is determined that the resulting frame is one wherein the voice is present. When the frame maximum power Pf(i) is smaller than the value that has been obtained by adding the second threshold value TH2 (<TH1) to the background noise power Pb(i), it is determined that the resulting frame is one wherein the voice is absent. When the frame maximum power Pf(i) is intermediate between both threshold values, if the first-order reflection coefficient r1(i) is not smaller than the third threshold value TH3 or if the second-order reflection coefficient r2 (i) is not larger than the fourth threshold value TH4, the resulting frame is determined to be one wherein the voice is present and, in the other cases, is determined to be one wherein the voice is absent.

It is assumed that each of the above-mentioned respective values is expressed in the form of 16-bit data words.

Figure 8:
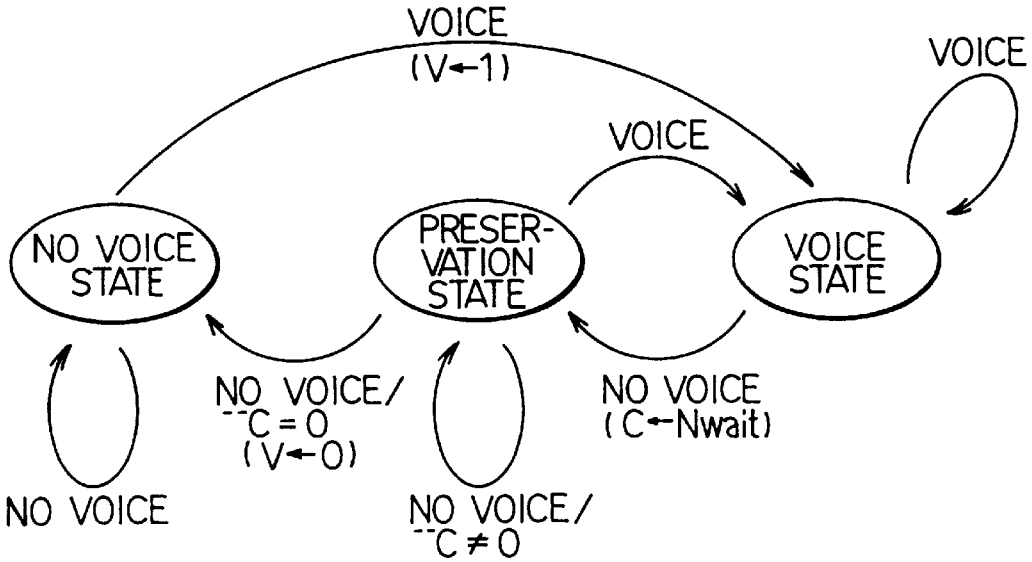
FIG. 8 is a state diagram of a period determination process.
Figures 9A, 9B, 9C, 9D, 9E, 9F:
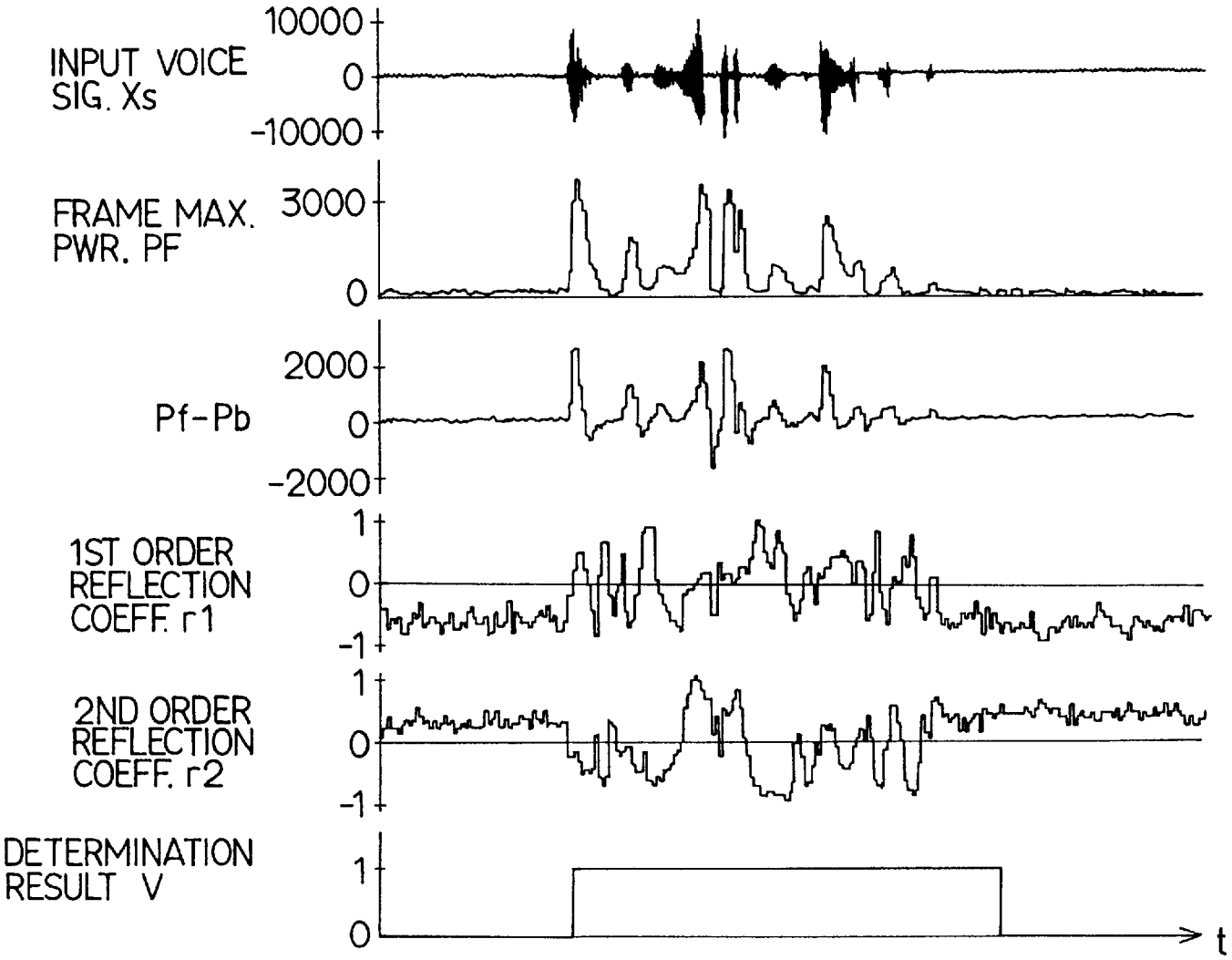
FIGS. 9A–9F are graphs showing the signal waveforms in respective sections of the voice presence/absence discriminator.

Next, the period determination process is explained with the use of FIG. 8 which is a state diagram. It is to be noted that this process is intended to shift the voice state among three states of a voice presence state, preservation state and voice absence state according to the frame state FS that is set based on the execution of the previous voice presence/absence determination process and to set the determination result V that represents the voice presence or absence period in correspondence with each of these three states.

First, the voice presence state is one which corresponds to the case where the frame that has been previously processed is one wherein the voice is present (FS=1). In this state, the determination result V is set to be at a value (V=1) that represents the voice presence period. Then, when the frame that has been newly processed has been determined to be one wherein the voice is present (FS=1) as a result of the execution of the voice presence/absence determination process, the voice presence state remains in the voice presence state as is. On the other hand, when the frame that has been newly processed has been determined to be one wherein the voice is absent (FS=0), the voice state is shifted to the preservation state and also the voice absence frame counter C is set to a prescribed value Nwait (20 in this embodiment). It is to be noted that in this preservation state, the determination result V is held to be at the value (V=1) that represents the voice presence period as in the case of the voice presence state.

Then, in the preservation state, when the frame that has been newly processed has been determined to be one wherein the voice is present, the voice state is shifted to the voice presence state. On the other hand, when this frame has been one wherein the voice is absent, the voice absence frame counter C is decremented. Then, when the value of the resulting counter C is not 0, the preservation state remains in the preservation state. When this value is 0, the determination result V is set to be at the value (V=0) that represents the voice absence period, whereupon the preservation state is shifted to the voice absence state.

In this voice absence state, when the frame that has been newly processed has been determined to be one wherein the voice is absent, the voice absence state remains as is. On the other hand, when this frame has been determined to be one wherein the voice is present, the determination result V is set to be at the value (V=1) that represents the voice presence period, whereupon the voice absence state is shifted to the voice presence state.

That is, in this process, the voice presence state and preservation state are determined to be the voice presence period (V=1) and the voice absence state is determined to be the voice absence period (V=0), in correspondence with which the determination result V is set.

When the voice state is in the voice absence period, upon receipt of one voice presence frame, the voice state is determined immediately to be the voice presence period while, on the other hand, when the voice state is in the voice presence period, the voice state is determined to be the voice absence period when the number of voice absence frames has reached 20 or more, that is, when the voice absence state has continued during a time period of 400 ms or more.

By the determination result V of the determined voice presence period/absence period being input to the transmission control section 16 as mentioned above, as explained previously, the start/stop of the transmitter 18 and the transmission of the coded data are controlled.

Here, FIGS. 9A–9F, 10A–10E and 11A–11C are graphs showing the results of a simulation using as an input voice signal a voice signal wherein the noise recorded within the compartment interior of a traveling vehicle is superimposed in an S/N ratio of 15 dB on the voice that has been prepared by the utterance that has been made within a quiet room at intervals of approximately 2 seconds.

Among these figures, FIGS. 9B–9F are graphs respectively showing the frame maximum power Pf, the difference Pf–Pb between the frame maximum power Pf and the background noise power Pb, both being calculated in the voice presence/absence discriminator 14, the first and second-order reflection coefficients r1 and r2 calculated by the voice encoder 12, and the determination result V which is the output of the voice presence/absence discriminator 14. The abscissa represents time and the ordinates represent respectively the values of the above items when expressed by a signed-16 bit integer representation.

As shown in the Figures, during the period in which no voice signal resulting from the utterance exists, the first-order reflection coefficient r1 becomes an approximately fixed value that is near −1 and the second-order reflection coefficient r2 becomes an approximately fixed value that is near +1. On the other hand, during the period in which the voice signal exists, the reflection coefficients r1 and r2 each largely fluctuate, with the result that the characterizing feature wherein the waveform of the reflection coefficient differs prominently according to the presence and absence of the voice signal is clearly exhibited.

Also, during the period in which no utterance is made, the difference between the frame maximum power Pf and the background noise power Pb changes while having relatively small values and, at the starting end of the utterance, the values thereof increases rapidly.

As a result of the voice presence or absence having been determined based on the difference between the frame maximum power Pf and background noise power Pb and the reflection coefficients r1 and r2 having such a characterizing feature, the period in which the voice signal resulting from the utterance exists is determined reliably to be the voice presence period (V=1).

Figures 10A, 10B, 10C, 10D, 10E:
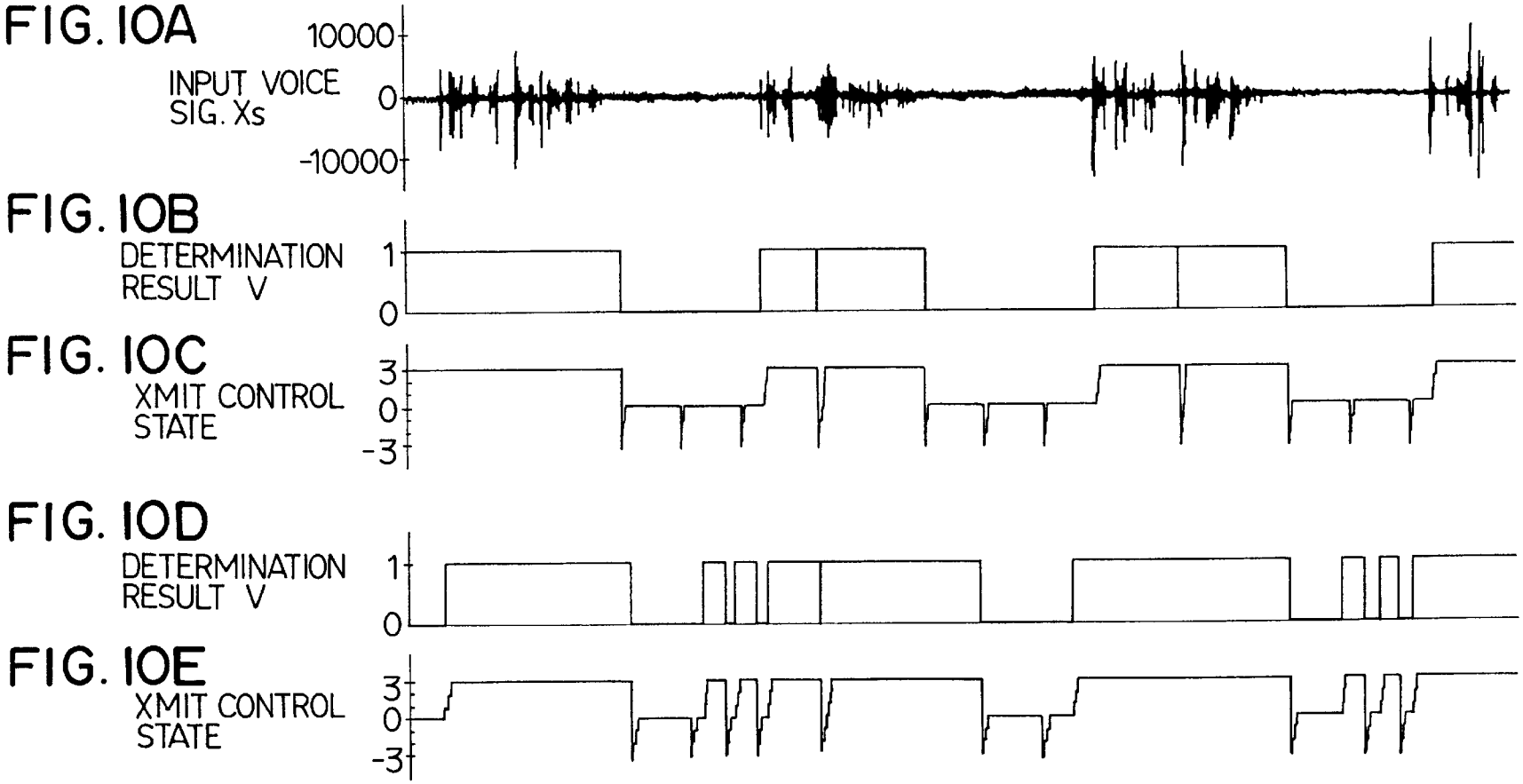
FIGS. 10A–10E are graphs showing the determination results of the voice presence/absence discriminator and the operation state of the transmission control section.

FIG. 10A represents the input voice signal Xs and each of FIGS. 10B and 10C represent the determination result V and the control state of the transmission control section 16. Particularly, FIG. 10B corresponds to the case where the voice presence/absence discriminator according to this embodiment is used and FIG. 10C corresponds to the case where the voice presence/absence discriminator that is arranged, when the difference between the frame maximum power Pf and the background noise power Pb is not smaller than the second threshold value TH2, to determine the input voice signal to be one wherein the voice is present and, when the former is smaller than the latter, to determine the input voice signal to be one wherein the voice is absent is used.

It is to be noted that the representation of the transmission state is such that 3 corresponds to a state where the coded data is being transmitted; 0 corresponds to a state where the transmission thereof is being stopped; 1 and 2 correspond to a state where the preamble is being transmitted; and −3, −2 and −1 correspond to a state where the postamble is being transmitted.

Also, the postamble that is transmitted periodically during the absence of the voice is not one which is transmitted according to the voice presence/absence determination but one which, as explained previously, is transmitted during the voice absence period at the rate of once per 1000 ms.

As shown in FIGS. 10B and 10C, although in FIG. 10B determination is made using only the power value of the frame the erroneous determination that the background noise period is the voice presence period is made at several portions of the background noise period in which only the background noise alone is being input, in FIG. 10C in the case of this embodiment the background noise period in which only the background noise alone is being input is determined reliably to be the voice absence period.

Figures 11A, 11B, 11C:
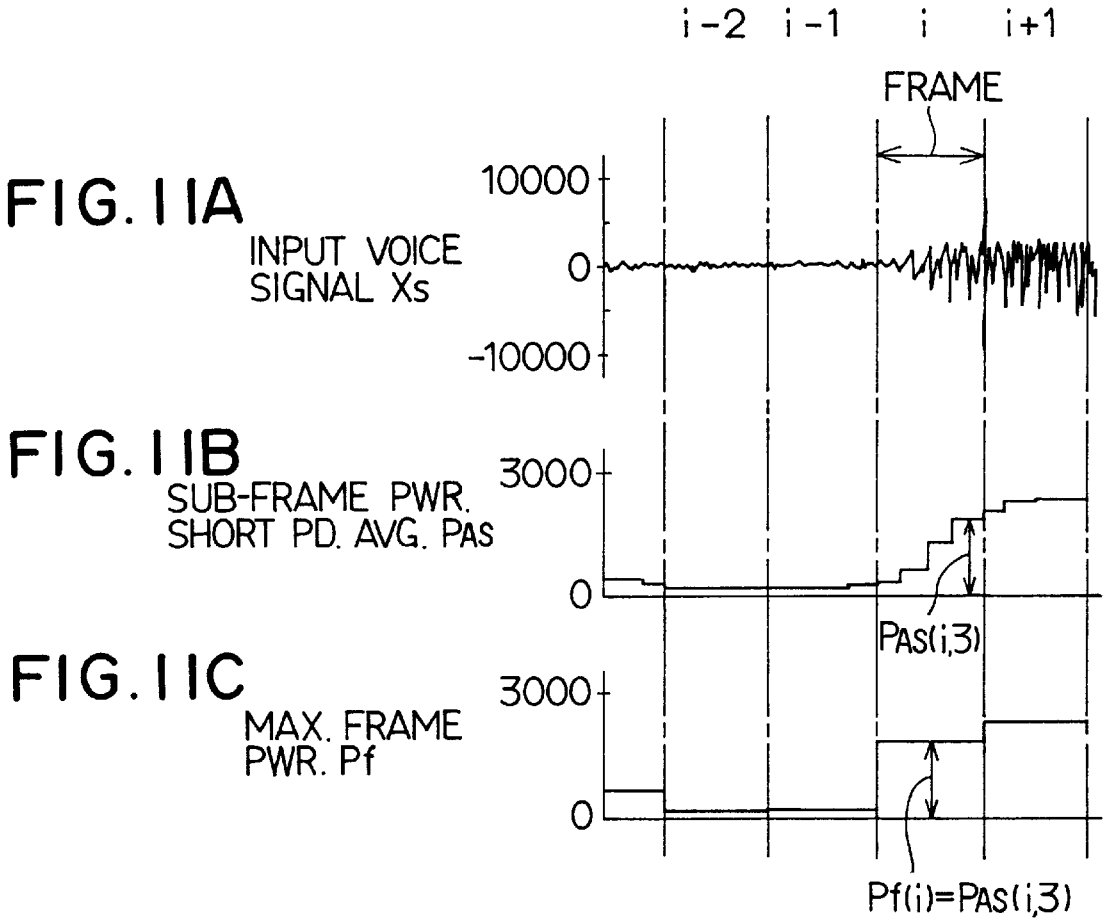
FIGS. 11A–11C are graphs showing the calculation results of the frame maximum power during a change from voice absence to voice presence.

FIGS. 11A–11C are graphs of an enlarged view of a forward end portion of the second utterance portion of FIGS. 10A–10C.

As shown in FIGS. 11A–11C, while utterance is started from a mid point of the (i) frame, as the frame maximum power Pf thereof there is selected a maximum one from among the short-period average values PAS of the sub-frame powers that have been determined every sub-frame. For this reason, as the frame maximum power Pf there can be obtained a sufficiently large value, with the result that this (i) frame is determined reliably to be the voice presence frame.

As explained previously, in this embodiment, the voice presence/absence discriminator 14 is arranged to perform calculation of the sub-frame power every sub-frame that is prepared by further dividing the frame in units of which the voice signal Xs is encoded into sub-frames, to further perform calculation in units of this sub-frame of the moving average values (short-period average value) PAS of this sub-frame and the sub-frame that precedes one in number, to compare these short-period average values PAS with each other among the sub-frames that constitute the same frame, and to determine a maximum one of them to be the frame maximum power Pf of this frame to thereby determine, based on this frame maximum power Pf, whether or not the frame is one wherein the voice is present.

According to this embodiment, even when an utterance has been made from the ending half of the frame, the frame maximum power Pf thereof substantially coincides with the power level of the voice signal. Therefore, in even such a case, it is possible to determine the frame to be the voice presence frame reliably and as a result it is possible to reliably prevent the occurrence of the uttered syllable head reproduction failure due to the omission of the frame containing therein the uttered syllable head, whereby it is possible to ensure excellent telephone talk communication quality.

Also, according to this embodiment, since the frame maximum power Pf and the background noise power Pb are determined using the moving average values of the sub-frame powers, even when sudden superimposition of noise occurs, it is possible to mitigate the resulting influence to thereby prevent the occurrence of erroneous determinations due to the noise.

Also, further, since the determination on each frame of the voice presence or absence is performed using not only the difference between the frame maximum power Pf and background noise power Pb thereof but also the first and second-order reflection coefficients r1 and r2 in which the difference in the frequency spectrum envelope configuration is reflected, even when the background noise is high in magnitude with the result that determination is difficult to make if using only the frame maximum power Pf and background noise power Pb alone, it is possible to determine the voice presence or absence reliably. Further, since the voice presence or absence of the frame can be used as mentioned above, it is possible to perform the VOX control effectively.

That is, if during the voice absence period the erroneous determination that the voice absence frame is determined to be the voice presence frame erroneously occurs, the voice absence period shifts immediately to the voice presence period with the result that the transmitter 18 is started by the transmission control section 16 and as a result unnecessary power is consumed. However, the occurrence of such an inconvenience can be reliably prevented.

Also, in this embodiment, even when in the voice presence period detection has been made for the voice absence frame, the voice presence period is not permitted to change immediately to the voice absence period and, when detection has been made of the voice absence frame for a prescribed, or larger than prescribed, consecutive number of frames, the voice presence period is permitted to change to the voice absence period.

Accordingly, a short state of voice absence such as breathing that occurs during the conversation is not determined to be the voice absence period, and it is possible to prevent the omission of the voice due to the processing for VOX control which is executed at the time of a change between the voice presence period and the voice absence period.

That is, in order to notify the receiving side that the transmitter 18 is stopped or started by the VOX control, when the voice signal has changed from the voice presence period to the voice absence period, the system transmits the postamble that corresponds to the three frames and, when the voice signal conversely has changed from the voice absence period to the voice presence period, the system transmits the preamble that corresponds to the two frames. For this reason, when the voice signal changes from the voice presence period to the voice absence period once, even when the voice signal has changed from the voice absence period again to the voice presence period immediately thereafter, the transmission of the postamble and preamble disables the transmission of the voice signal during the period that corresponds to at least 5 frames (100 ms), with the result that the voice that has occurred during this period fails to be reproduced. However, since a short state of voice absence such as breathing is not processed as the voice absence period but processed as the voice presence period, it is possible to prevent the occurrence of such a voice reproduction failure.

Although the present invention has been fully described in connection with the preferred embodiment thereof with reference to the accompanying drawings, it is to be noted that various changes and modifications will become apparent to those skilled in the art. For example, although in the above-mentioned embodiment the first and second-order reflection coefficients are used, the first-order reflection coefficient alone or second-order reflection coefficient alone may be used, or third or higher order reflection coefficient may be also used concurrently. Also, while in the above-mentioned embodiment the length of the frame is 20 ms, the present invention also permits the use of a more lengthy frame (e.g., 40 ms). In this case, if the size of the sub-frame is the same, it is possible to prevent the occurrence of the uttered syllable head reproduction failure with the same precision.

Such changes and modifications are to be understood as being included within the scope of the present invention as defined by the appended claims.

What is claimed is:

1. A voice presence/absence discriminator for dividing an input voice signal into unitary base frames each of which corresponds to a prescribed time period and for discriminating between the voice presence and voice absence in each base frame, said discriminator comprising:

voice signal generation means for generating said input voice signal;

frame generation means for dividing said input voice signal into a plurality of base frames and for dividing each of said base frames into a plurality of sub-frames;

sub-frame power calculation means for calculating respective sub-frame electric powers of said sub-frames;

frame maximum power production means for determining a frame maximum power of each of said base frames to be a maximum one of values related to sub-frame powers corresponding to a respective base frame;

background noise power estimation means for estimating a background noise electric power based on a plurality of consecutive sub-frames electric powers that include a most recent sub-frame power; and voice presence/absence discrimination means for discriminating between a voice presence condition and a voice absence condition of said input voice signal for each base frame based on a difference between said frame maximum power and said background noise power.

2. The discriminator of claim 1, wherein said frame maximum power production means comprises:

short-period average value calculation means for, each time a sub-frame power is calculated by said sub-frame power calculation means, calculating, based on a prescribed number of consecutive sub-frame electric powers, which are smaller in number than a number of sub-frames into which base frames are decided, and which include a most recent sub-frame power having been calculated by said sub-frame power calculation means, short-period average values each of which is an electric power average value of the prescribed number of consecutive sub-frames electric powers;

wherein said frame maximum power production means determines a maximum one of the short-period average values to be said frame maximum power.

3. The discriminator of claim 2, wherein said background noise power estimation means comprises:

long-period average value calculation means for, each time a sub-frame power is calculated by said sub-frame power calculation means, calculating, based on a prescribed number of consecutive sub-frame electric powers, which are larger in number than a number of sub-frames into which base frames are decided, and which include a most recent sub-frame power having been calculated by said sub-frame power calculation means, long-period average values each of which is an electric power average value of the prescribed number of consecutive sub-frames electric powers; and selection means for determining as a background noise power of each base frame a minimum one of long-period average values of sub-frames corresponding to a respective base frame, which have been calculated by the long-period average value calculation means.

4. The discriminator of claim 1, wherein said background noise power estimation means comprises:

long-period average value calculation means for, each time a sub-frame power is calculated by said sub-frame power calculation means, calculating, based on a prescribed number of consecutive sub-frame electric powers, which are larger in number than a number of sub-frames into which base frames are decided, and which include a most recent sub-frame power having been calculated by said sub-frame power calculation means, long-period average values each of which is an electric power average value of the prescribed number of consecutive sub-frames electric powers; and selection means for determining as a background noise power of each base frame a minimum one of long-period average values of sub-frames corresponding to a respective base frame, which have been calculated by the long-period average value calculation means.

5. The discriminator of claim 1, further comprising:

parameter extraction means for performing linear estimated analysis on said input voice signal in units of base frames to thereby extract a characteristic parameter that represents a characteristic of a frequency spectrum envelope of said input voice signal;

wherein said voice presence/absence discrimination means includes first determination means for determining a base frame wherein a difference between a frame maximum power and a background noise power thereof is not smaller than a prescribed first threshold value to be a voice presence frame and for determining a base frame wherein the difference therebetween is not greater than a prescribed second threshold value that is smaller than said first threshold value to be a voice absence frame, and second determination means for, when said difference therebetween is greater than said first threshold value and smaller than said second threshold value, performing a determination of said voice presence condition and said voice absence condition based on said characteristic parameter extracted by said parameter extraction means.

6. The discriminator of claim 5, wherein said characteristic parameter extracted by said parameter extraction means is a lower-order reflection coefficient.

7. The discriminator of claim 1, further comprising period determination means for, of voice presence frames that have been so determined by said voice presence/absence discrimination means and voice absence frames that have been so determined thereby, determining a voice presence frame and a prescribed, and smaller than prescribed, number of voice absence frames that consecutively succeed said voice presence frame to be a voice presence period and determining voice absence frames that further consecutively succeed the prescribed number of voice absence frames to be a voice absence period.

8. A voice presence/absence discriminator for dividing an input voice signal into unitary base frames each of which corresponds to a prescribed time period and for discriminating between the voice presence and voice absence in each base frame, said discriminator comprising:

voice signal generation means for generating said input voice signal;

frame generation means for dividing said input voice signal into a plurality of base frames and for dividing each of said base frames into a plurality of sub-frames;

sub-frame power calculation means for calculating respective sub-frame electric powers of said sub-frames;

voice presence/absence discrimination means for determining a base frame to be a voice presence frame if a value representative of sub-frame powers of sub-frames of said base frame exceeds a specified parameter, wherein said background noise power estimation means comprises:

long-period average value calculation means for, each time a sub-frame power is calculated by said sub-frame power calculation means, calculating, based on a prescribed number of consecutive sub-frame electric powers, which are larger in number than a number of sub-frames into which base frames are decided, and which include a most recent sub-frame power having been calculated by said sub-frame power calculation means, long-period average values each of which is an electric power average value of the prescribed number of consecutive sub-frames electric powers; and selection means for determining as a background noise power of each base frame a minimum one of long-period average values of sub-frames corresponding to a respective base frame, which have been calculated by the long-period average value calculation means; and reference value setting means for setting said specified parameter based on a selected background noise power.

9. A method of detecting a voice presence condition of an electrical signal, said method comprising the steps of:

dividing said signal into a plurality of base frames;

dividing each of said base frames into a plurality of sub-frames;

calculating power parameters representative of powers of said sub-frames;

determining a voice presence condition in a portion of said signal corresponding to a base frame in which one of said power parameters exceeds a first given level, determining a background noise power level of said signal; said background noise power level is estimated based on a plurality of consecutive sub-frames electric powers that include a most recent sub-frame power; and setting said first given level based on said background noise power level.

10. The method of claim 9, wherein said background noise power level determining step comprises the steps of:

calculating a plurality of moving averages of said sub-frame powers; and selecting a minimum value in said plurality of moving averages as said background noise power level.

11. The method of claim 10, wherein a number of sub-frame powers averaged in each of said plurality of moving averages is greater than a number of sub-frames into which each of said base frames is divided.

12. The method of claim 9, said value calculating step comprising the steps of:

calculating a plurality of moving averages of said sub-frame powers; and selecting a maximum value in said plurality of moving averages as a power parameters corresponding to a base frame containing said averaged sub-frame powers.

13. The method of claim 12, wherein a number of sub-frame powers averaged in each of said plurality of moving averages is less than a number of sub-frames into which each of said base frames is divided.

14. The method of claim 9, further comprising the step of determining a voice absence condition in a portion of said signal corresponding to a base frame in which one of said power parameters exceeds a second given level.

15. The method of claim 14, further comprising the steps of:

determining a background noise power level of said signal; and setting said second given level based on said background noise power level.

16. The method of claim 15, wherein said background noise power level determining step comprises the steps of:

calculating a plurality of moving averages of said sub-frame powers; and selecting a minimum value in said plurality of moving averages as said background noise power level.

17. The method of claim 16, wherein a number of sub-frame powers averaged in each of said plurality of moving averages is greater than a number of sub-frames into which each of said base frames is divided.

18. The method of claim 9, further comprising the steps of:

calculating a first-order reflection coefficient of said base frame; and determining a voice presence condition in a portion of said signal corresponding to said base frame when said first-order reflection coefficient is greater than a second given level.

19. The method of claim 9, further comprising the steps of:

calculating a second-order reflection coefficient of said base frame; and determining a voice presence condition in a portion of said signal corresponding to said base frame when said second-order reflection coefficient is less than a second given level.

* * * * *